US006550855B2

(12) United States Patent
Liu

(10) Patent No.: US 6,550,855 B2
(45) Date of Patent: Apr. 22, 2003

(54) FOLDING CHAIRS

(76) Inventor: Lausan Chung-Hsin Liu, No. 243, Chien-Kuo Rd., Hsin-Tien City, Taipei Hsien (TW)

( * ) Notice: Subject to any disclaimer, the term of this patent is extended or adjusted under 35 U.S.C. 154(b) by 0 days.

(21) Appl. No.: 09/915,305

(22) Filed: Jul. 27, 2001

(65) Prior Publication Data

US 2003/0020305 A1 Jan. 30, 2003

(51) Int. Cl.[7] ..... A47C 4/00

(52) U.S. Cl. ..... 297/42; 297/45; 297/452.2; 297/451.13

(58) Field of Search ..... 297/45, 42, 452.2, 297/451.13

(56) References Cited

U.S. PATENT DOCUMENTS 1,856,759 A * 5/1932 Grondin ..... 248/436
2,959,212 A * 11/1960 Bauer ..... 297/45
4,065,173 A * 12/1977 Gittings ..... 16/366
4,579,383 A * 4/1986 Colby ..... 297/411.42
5,873,624 A * 2/1999 Simpson ..... 297/173
5,988,755 A * 11/1999 Fastelli et al. ..... 297/440.1

* cited by examiner

*Primary Examiner*—Milton Nelson, Jr.
*Assistant Examiner*—Sarah C. Burnham
(74) *Attorney, Agent, or Firm*—Bacon & Thomas

(57) ABSTRACT

An improved folding chair comprises two support frames and toggle joint bars bridging the two support frames about an axis in a cross and staggered manner to form a seating zone. The two opposing inner sides of the front post and the rear post of the support frames have respectively a hollow coupling sleeve mounted thereon to couple with two ends of linkage bar. The coupling sleeve has an extending stepwise pivotal neck to couple with a tubular rod to attach the toggle joint bars such that the toggle joint bars are turnable about the axis to turn the tubular rod about the pivotal neck to allow the support frame and the toggle joint bars to fold toward one another.

6 Claims, 5 Drawing Sheets

FOLDING CHAIRS

BACKGROUND OF THE INVENTION

The present invention relates to improved folding chairs and particularly a folding chair that provides improved sitting support to people and is easy to fold to a small size.

Outdoor leisure and recreational activities are very popular these days. As many people live and work in highly competitive environments, and have accumulated a lot of tension and stress, to participate in some outdoor activities such as field trip, camping, or Bar-B-Q help people to release the tension and stress, and can improve quality of life. It often happens that some recreational sites do not have all the facilities required. In order to better enjoy the outdoor activities, people have to carry some outdoor articles and good with them, especially tables and chairs. Hence to shrink the a size of the tables and chairs so that they can be carried and stored conveniently but still can provide sufficient function when in use has become an important issue to the furniture producers.

Folding chair are widely used nowadays, such as in outdoor trips, school activities, provisional meetings, etc. In the earlier days, folding chairs were mostly made of woods. As wooden chairs are heavy, they are rarely used these days.

In order to remedy the shortcomings of the folding chairs in the past, contemporary folding chairs generally adopt metal chair frames made of steel tubes, aluminum tubes or steel rods. They are bent to desired shapes, then are coupled and stitched with seat pads and backrests made of canvas or fabrics. They are generally light weight and printable, and are easy to fold to small sizes for carrying.

Whereas, aforesaid folding chairs mostly have the seat pad pivotally engaged to the backrest. After using for a period of time, the seat pad tends to sag and cause deformation on the pivotal section. As a result, the pivotal section could not function properly, and make folding or extending of the chair difficult. It becomes an annoying problem to users.

Moreover, the seat pad and backrest usually are fixedly stitched to the chair frame. Once assembled, they are not possible to remove or separate from the chair frame. Hence when using for a period of time, the seat pad and backrest could become smeared or frayed. As the seat pad and backrest cannot be removed for washing and cleaning or replacement, the whole set of folding chairs has to be thrown away. It is a costly waste.

SUMMARY OF THE INVENTION

The primary object of the invention is to resolve the foregoing disadvantages. The invention aims to provide an improved folding chair that offers better sitting support to people and may be folded easily to a small size.

Another object of the invention is to provide a seat pad and backrest that may be assembled separately to facilitate washing and cleaning or replacement of different styles.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
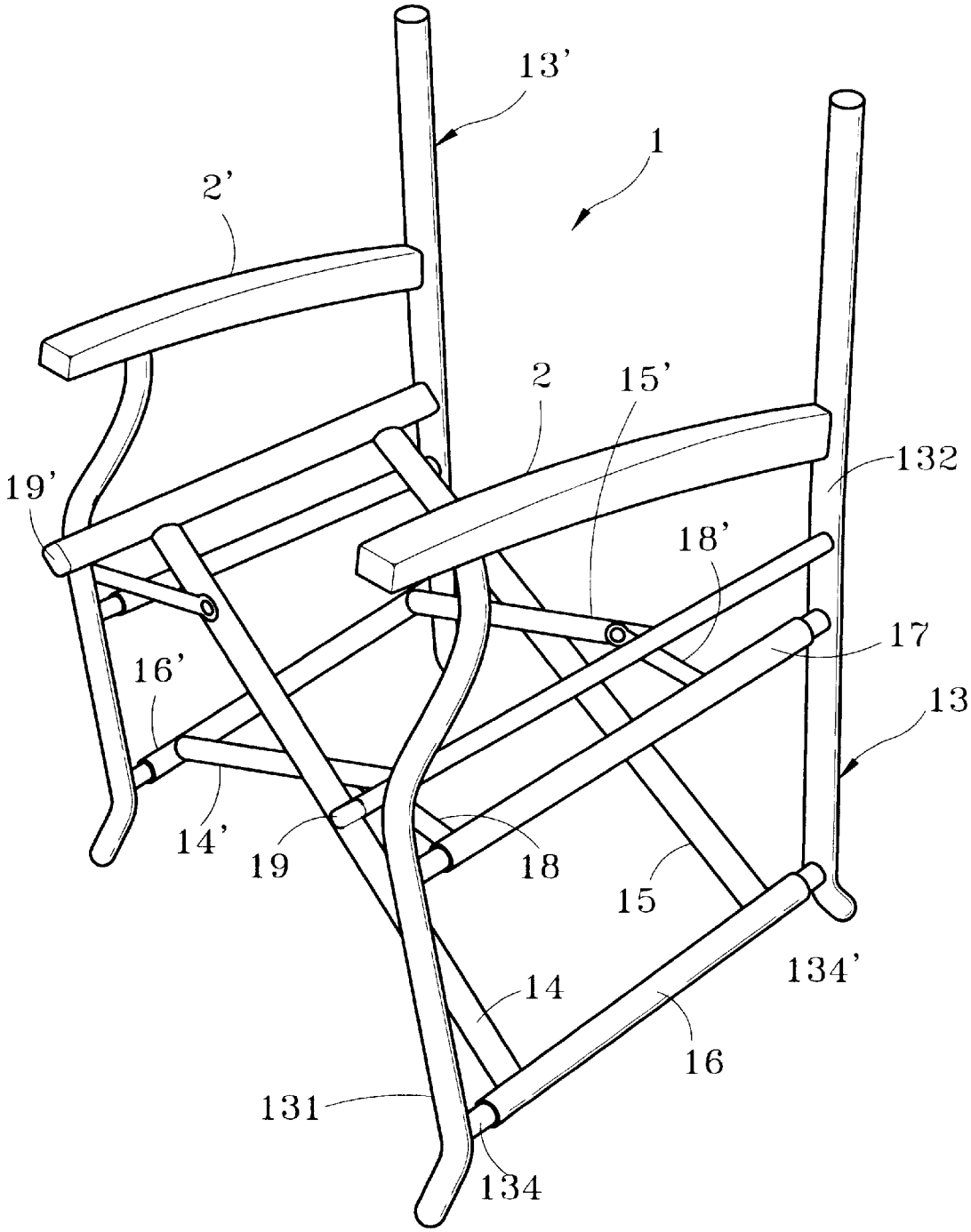
FIG. 1 is a perspective view of the invention.
Figure 2:
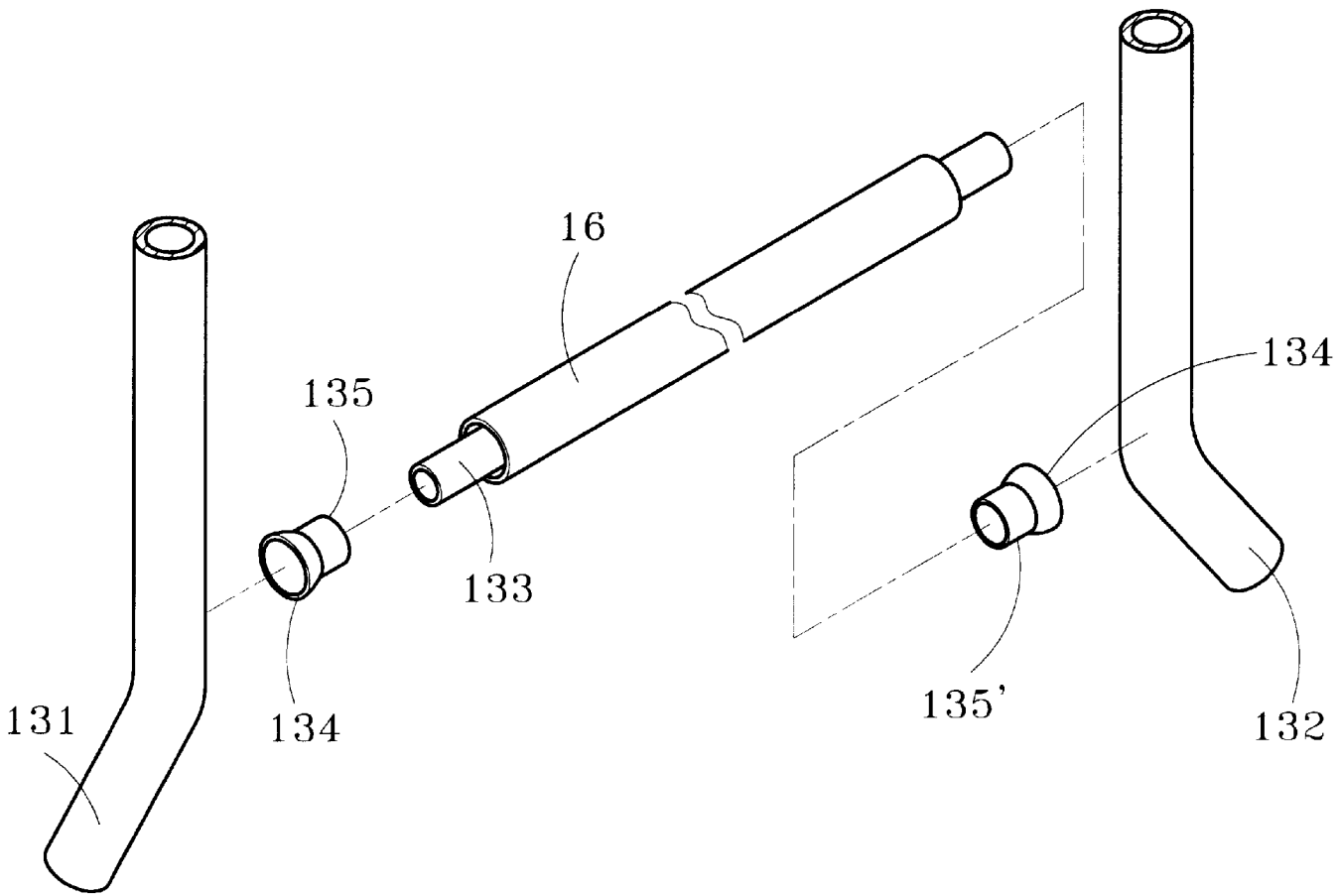
FIG. 2 is a fragmentary exploded view of the invention.

Referring to FIGS. 1 and 2, the folding chair 1 of the present invention includes at least two support frames 13 and 13' each consists of a front post 131, a rear post 132, and a linkage bar 133 bridging the front and rear post 131 and 132. The two support frames 13 and 13' are bridged by toggle joint bars 14, 14', 15 and 15' which are pivotally engaged with each other on an axis in a cross and staggered manner to form a seating zone. The opposing inner sides of the front post 131 and rear post 132 have respectively a hollow coupling sleeves 134 and 134' mounted thereon to engage with two ends of the linkage bar 133. The linkage bar 133 may also be integrally formed with the coupling sleeves 134 and 134'. The coupling sleeves 134 and 134' have respectively a stepwise pivotal neck 135 and 135' extending outwards to couple with a tubular rod 16 and 16'. The toggle joint bars 14, 14', 15 and 15' have respectively one end attached to the tubular rod 16 and 16' such that the tubular rod 16 and 16' are turnable about the pivotal neck 135 and 135', and the toggle joint bars 14, 14', 15 and 15' are tumble about the pivotal axis to move support frames 13 and 13' toward each other for folding.

Figure 3A:
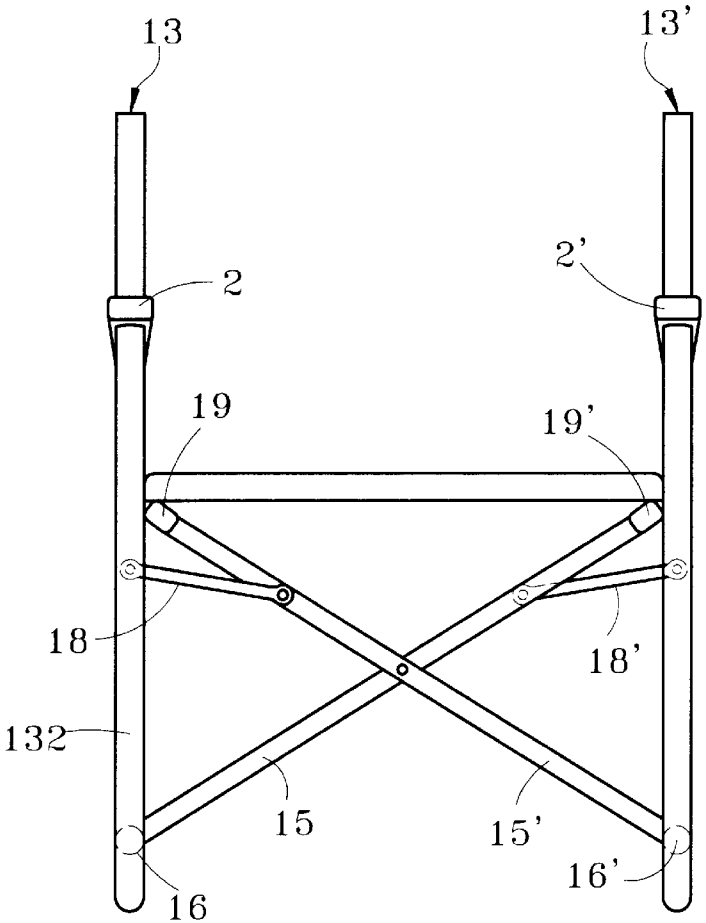
FIGS. 3A, 3B and 3C are schematic views of the invention under folding.
Figure 3B:
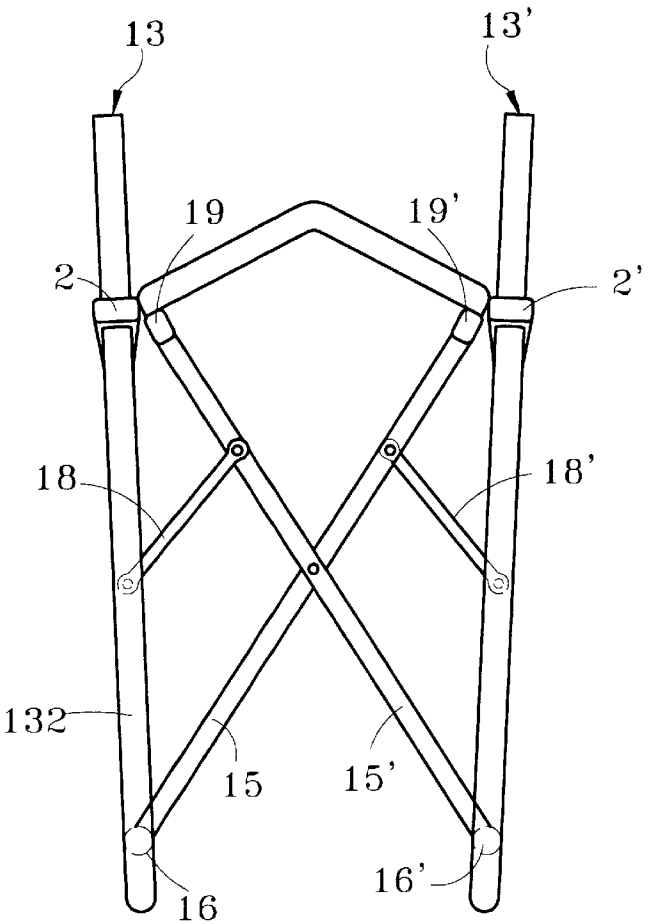
Figure 3C:
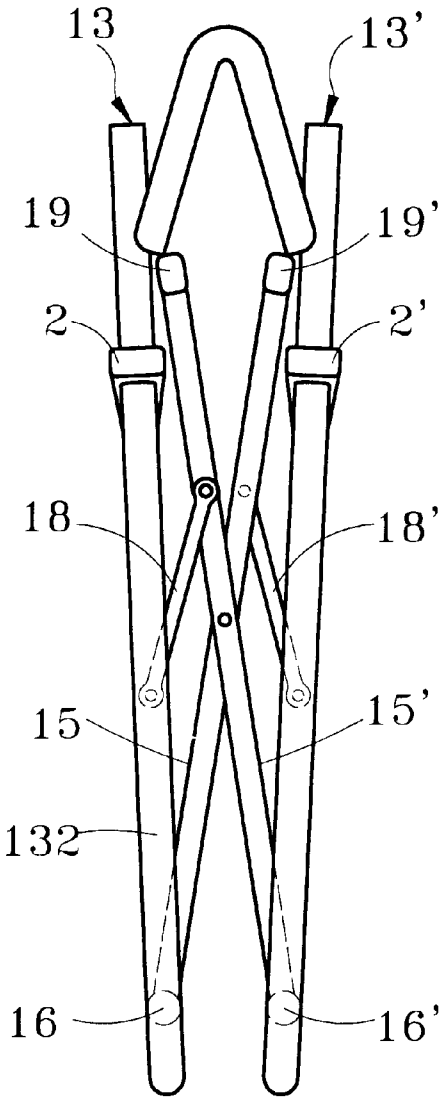

Referring to FIGS. 3A, 3B and 3C, the folding chair 1 further has a pair of armrest 2 and 2' located between the front and rear post 131 and 132 to give sitting people more comfort, and also to facilitate folding of the chair 1. When folding the chair 1, apply force on the armrests 2 and 2' to move the support frames 13 and 13' toward each other. The tubular rod 16 and 16' will turn about the pivotal neck 135 and 135', and the toggle joint bars 14, 14', 15 and 15' will be compressed and turned about the pivotal axis and move toward each other to fold the chair 1. In addition, another set of coupling sleeves 134 and 134', linkage bar 133, and tubular rod 17 may be added to the support frames 13 and 13'. Auxiliary levers 18 and 18' are provided to pivotally link the tubular rod 17 and the toggle joint bars 14, 14', 15 and 15'. Hence when the folding chair 1 is extended for use, it can provide more secured and sturdy sitting support to people. The tubular rod 17 and the toggle joint bars 14, 14', 15 and 15' may be moved and folded like the tubular bar 16 and the toggle joint bars 14, 14', 15 and 15' set forth above. The folding chair 1 thus made may be folded to a small size easily to facilitate carrying or storing.

Figure 4:
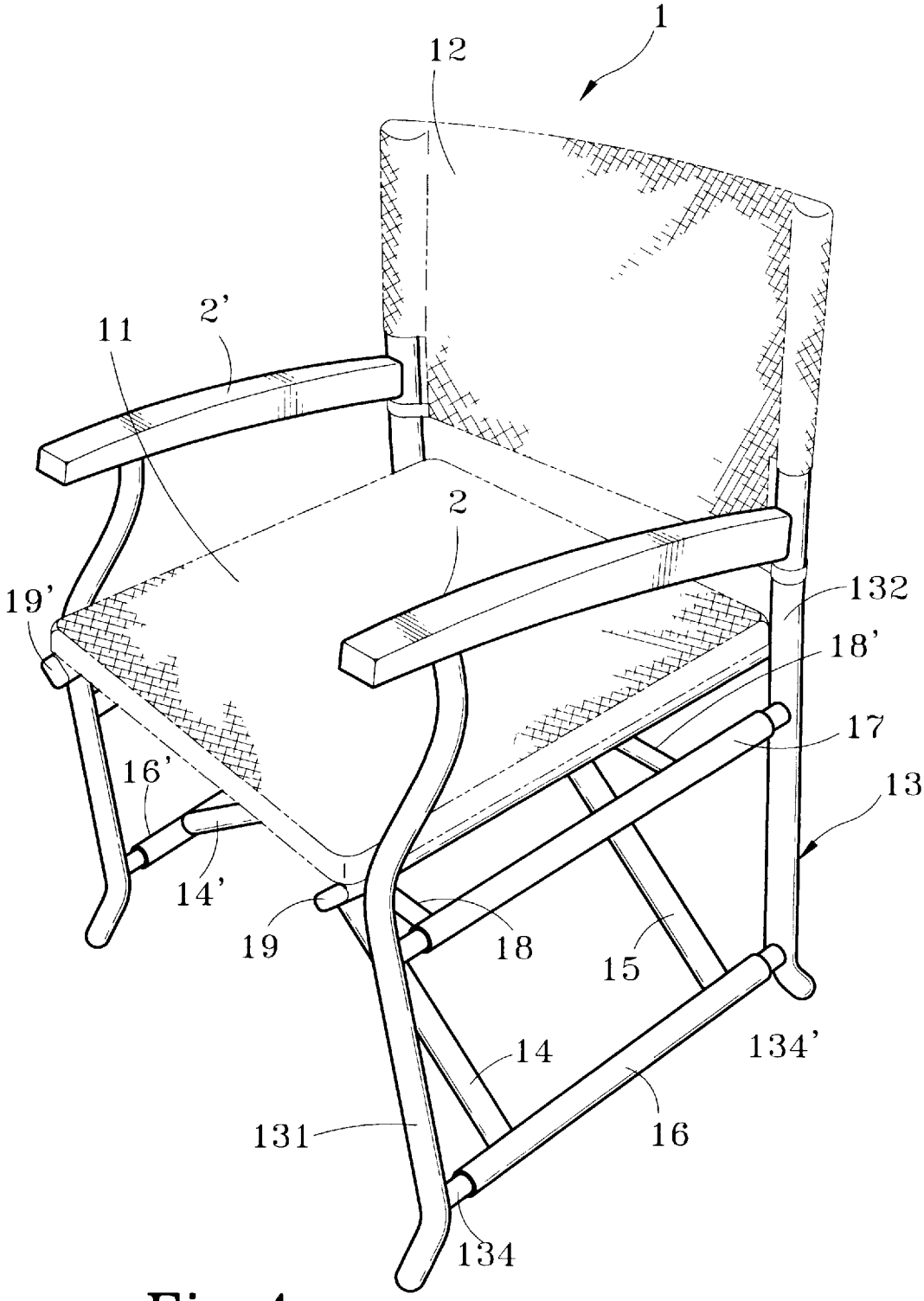
FIG. 4 is a schematic view of an embodiment of the invention.

Referring to FIG. 4, the cross and staggered toggle joint bars 14, 14', 15 and 15' may form a seating zone. And a pair of support beams 19 and 19' may be fastened to the top end of the toggle joint bars 14, 14', 15 and 15'. A seat pad 11 may be fastened to the support beams 19 and 19'. A backrest 12 may have two ends coupled to the rear post 131 behind the support beams 19 and 19' by bonding or sleeve coupling. The seat pad 11 and backrest 12 may be detached and moved away from the chair 1 for washing and cleaning whenever desired. When the seat pad 11 and backrest 12 are tattered or frayed, or users want to change for other styles, they can be removed for replacement easily without the need to replace the whole set of chair. It is more cost effective.

What is claimed is:

1. An improved folding chair, comprising:

at least two support frames each including a front post, a rear post and a linkage bar bridging the front and the rear post; and toggle joint bars bridging the two support frames about an axis in a cross and staggered manner to form a seating zone;

wherein opposing inner sides of the front post and the rear post each have respectively a hollow coupling sleeve mounted thereon to engage respectively with each end of the linkage bar, the coupling sleeve having a stepwise pivotal neck extended from one end thereof to couple a tubular rod surrounding a portion of the linkage bar and to attach the toggle joint bars such that the toggle joint bars are turnable about an axis of the linkage bar to turn the tubular rod about the pivotal neck to allow the support frames and the toggle joint bars to fold toward one another.

2. The improved folding chair of claim 1 further having another set of coupling sleeves, linkage bar, and tubular rod located between the support frames, and auxiliary levers bridging the tubular rod and the toggle joint bars.

3. The improved folding chair of claim 1, wherein the toggle joint bars fasten to a pair of support beams for fastening a seat pad.

4. The improved folding chair of claim 1, wherein the linkage bar and the coupling sleeve are integrally formed.

5. An improved folding chair, comprising:

at least two support frames each including a front post, a rear post and a linkage bar bridging the front and the rear post; and toggle joint bars bridging the two support frames about an axis in a cross and staggered manner to form a seating zone;

wherein opposing inner sides of the front post and the rear post each have respectively a hollow coupling sleeve mounted thereon to engage respectively with each end of the linkage bar, the coupling sleeve having a stepwise pivotal neck extended from one end thereof to couple a tubular rod surrounding a portion of the linkage bar and to attach the toggle joint bars such that the toggle joint bars are turnable about an axis of the linkage bar to turn the tubular rod about the pivotal neck to allow the support frames and the toggle joint bars to fold toward one another; and further having another set of coupling sleeves, linkage bar, and tubular rod located between the support frames, and auxiliary levers bridging the tubular rod and the toggle joint bars; and wherein the toggle joint bars fasten to a pair of support beams for fastening a seat pad.

6. The improved folding chair of claim 5, wherein the linkage bar and the coupling sleeve are integrally formed.

* * * * *